US006248140B1

(12) United States Patent
Genssler et al.

(10) Patent No.: US 6,248,140 B1
(45) **Date of Patent: *Jun. 19, 2001**

(54) FUEL COMPOSITION RECYCLED FROM WASTE STREAMS

(75) Inventors: Klaus Genssler, Houston; Raymond R. Ruth, Pearland, both of TX (US)

(73) Assignee: Scaltech Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/256,008

(22) Filed: Feb. 23, 1999

Related U.S. Application Data

(63) Continuation-in-part of application No. 09/246,071, filed on Feb. 8, 1999, now abandoned, and a continuation-in-part of application No. 09/124,689, filed on Jul. 29, 1998, which is a continuation of application No. 07/924,828, filed on Aug. 4, 1992, now Pat. No. 5,788,721.

(51) Int. Cl.[7] ..... C10H 1/32
(52) U.S. Cl. ..... 44/281
(58) Field of Search ..... 44/280, 281, 300, 44/311, 457

(56) References Cited

U.S. PATENT DOCUMENTS 4,081,285 * 3/1978 Pennell ..... 106/100
4,358,292 * 11/1982 Battista ..... 44/281
4,378,229 * 3/1983 Leen ..... 44/280
4,686,049 * 8/1987 Klobenzer et al. ..... 210/774
4,810,393 * 3/1989 Guinard ..... 210/774
4,842,616 * 6/1989 Verhille ..... 44/281
4,931,176 * 6/1990 Guinard ..... 210/179
4,983,296 * 1/1991 McMahon et al. ..... 210/603
5,141,526 * 8/1992 Chu ..... 44/605
5,439,489 * 8/1995 Scalliet et al. ..... 44/281
5,788,721 * 8/1998 Scalliet et al. ..... 44/281

* cited by examiner

*Primary Examiner*—Margaret Medley
(74) *Attorney, Agent, or Firm*—Conley, Rose & Tayon, P.C.

(57) ABSTRACT

A fuel composition comprising less than about 10 percent-by-weight water, greater than about 30 percent-by-weight solids and from about 30 to about 70 percent-by-weight of a combustible nonaqueous, generally water insoluble liquid, the composition having a minimum heat value of at least 5000 BTU per pound and a viscosity such that said composition is pumpable at ambient temperature, the composition being conveniently derived, for example, from a waste stream containing a liquid, nonaqueous fraction, a solids fraction and an aqueous fraction, such as refinery waste, waste from aluminum smelting processes, paint waste or other industries.

15 Claims, No Drawings

FUEL COMPOSITION RECYCLED FROM WASTE STREAMS

CROSS-REFERENCE TO RELATED APPLICATIONS

This application is a continuation-in-part of U.S. patent application Ser. No. 09/246,071, filed Feb. 8, 1999 and entitled "Fuel Composition Recycled from Waste Streams," now abandoned and also a continuation-in-part of U.S. patent application Ser. No. 09/124,689, filed Jul. 29, 1998 and entitled "Fuel Composition," which is a continuation of U.S. patent application Ser. No. 07/924,828, filed Aug. 4, 1992, and issued as U.S. Pat. No. 5,788,721, all of which are hereby incorporated by reference in their entireties.

STATEMENT REGARDING FEDERALLY SPONSORED RESEARCH OR DEVELOPMENT

Not Applicable.

FIELD OF THE INVENTION

The present invention relates to a fuel composition. More particularly, the present invention relates to a fuel composition derived at least in part from one or more waste streams. Still more particularly, the present invention relates to a fuel composition that is comprised of components from petroleum refining wastes, wastes from aluminum smelting processes, waste generated in the automotive, appliance and paint industries, and additional hydrocarbon streams.

BACKGROUND OF THE INVENTION

Waste product streams containing primarily water and smaller amounts of nonaqueous liquids and solids, both organic and inorganic, are by-products of processes used in various industries such as the refining, petrochemical and chemical industries, to name a few. For example, a typical waste stream from a refinery operation will contain about 80 percent-by-weight water, about 15 percent-by-weight oil, e.g., hydrocarbons and other nonaqueous liquids, and about 5 percent-by-weight solids. Other processing operations generating similar waste streams include aluminum smelting, and paint, appliance, and automotive manufacturing. Due to environmental regulations, these waste streams pose disposal problems.

It is known to treat a refinery waste stream, commonly referred to as sludge, which is a mixture of solids, water and oil products. Such sludge is treated to obtain either a solids stream that is a slurry of solids, both inorganic and organic, in a primarily aqueous medium, the slurry generally containing from about 15 to about 20 percent-by-weight solids content, or a non-pumpable dry solids cake. Such slurries, containing a relatively small amount, i.e., less than about 10 percent-by-weight, of nonaqueous liquids, e.g., hydrocarbons, can be incinerated. For example, they can be incinerated in furnaces used in spent sulfuric acid regeneration plants, cement kilns or the like. These prior art aqueous slurries have several disadvantages. For one, because of the high water content, they have a low heat value. Additionally, the solids content of the slurries cannot exceed about 20–25 percent lest they become so viscous as to be unpumpable at ambient temperature conditions. Accordingly, the cost of disposing of the slurries is increased because the transportation costs per unit weight of solids is relatively high. In the case of non-pumpable, dry solids cake, the solids content is generally 25 to 90 percent-by-weight. This cake requires special handling for disposal and is considerably more expensive than the slurries to dispose of.

The present invention overcomes the deficiencies of the prior art.

SUMMARY OF THE INVENTION

The present invention provides a method for disposing of at least a portion of such sludges and waste streams in a cost effective manner. Another object is to provide a disposal method that allows the recovery of some of the energy value in the waste stream. It is a further object of the present invention to provide a new fuel composition that is pumpable. Another object of the present invention is to provide a pumpable fuel composition derived from a waste stream containing water, nonaqueous liquids, inorganic solids and organic solids. Still a further object of the present invention is to provide a pumpable fuel composition having a relatively high solids content that can be disposed of more economically. The above and other objects of the present invention will become apparent from the description given herein and the claims.

The present invention provides a fuel composition comprising less than about 10 percent-by-weight water, greater than about 35 percent-by-weight solids, generally up to about 70 percent-by-weight solids, and from about 30 to about 65 percent-by-weight of a nonaqueous liquid. The fuel composition has a minimum heat value of about 5,000 BTU per pound and more preferably about 7,000 BTU per pound and a viscosity such that the composition is pumpable at ambient temperature. Depending on the source of the waste stream, one preferred embodiment of the present invention comprises a fuel composition comprising less than about 5 percent-by-weight water, greater than about 30 percent-by-weight solids, and from about 30 to about 65 percent-by-weight of a nonaqueous liquid and having a minimum heat value of about 10,000 BTU per pound

DESCRIPTION OF THE PREFERRED EMBODIMENT

The fuel composition of the present invention comprises water, solids and nonaqueous, liquids. Generally speaking, the water will be present in an amount of less than about 10 percent-by-weight, more preferably in the range of from about 0 to about 8 percent-by-weight. The solids, which can include both inorganic and organic containing materials, will comprise greater than about 35 percent-by-weight, generally up to about 70 percent-by-weight, the solids stream generally comprising from about 50–70 wt % inorganic solids and from about 30–50% organic solids. For certain waste streams, the organic solids are carbon-containing compounds that are substantially methylene chloride insoluble, but because of their carbon content are usually combustible. In other cases, the solids content can be substantially all organic, i.e., carbon-containing, or all inorganic. According to the present invention, the solids comprise particles having an average size less than 250 microns. If the solids initially present in the waste stream are larger than the preferred size, it is preferred that the process include a grinding step to reduce their size to the preferred range.

The nonaqueous liquids will generally comprise from about 30 to about 65 percent-by-weight of the fuel composition. The nonaqueous liquid can be virtually any combustible organic material. The nonaqueous liquid may be insoluble in water or have limited solubility in water. Nonlimiting examples of suitable nonaqueous liquids include hydrocarbons, alcohols, ketones, ethers, aldehydes, etc., as well as mixtures of such compounds. Typically, the nonaqueous liquids are referred to as "oil" or "solvent." As used herein, oil refers to any mixture of organic compounds typically found in waste streams or sludges in refineries, petrochemical plants and the like, which are generally immiscible with water. While such oils primarily comprise hydrocarbons, other organic compounds can also be present. Similarly, "solvent" refers to any mixture of organic compounds typically found in waste streams from manufacturing waste, paint waste and the like. While such solvents primarily comprise hydrocarbons, other organic compounds can also be present. The liquid hydrocarbons are optionally obtained from the same type of waste stream as said solids.

The fuel compositions of the present invention can also include dispersant and/or surfactants such as lignosulfonates.

The fuel composition may have a heat value as low as 5,000 BTU per pound, but will preferably have a minimum heat value of at least about 7000 BTU per pound, more preferably greater than about 8,000 BTU per pound, and still more preferably at least about 10,000 BTU per pound.

The fuel composition of the present invention, because it has a relatively high content of liquids that are less polar than water, does not become viscous, rendering it unpumpable at ambient temperature. Prior art slurries used for fuel in furnaces or cement kilns suffer from the disadvantage that, because the water content is high, the solids content must be kept below about 25 percent-by-weight in order that the slurry can be handled by conventional pumps. As can be seen, the fuel composition of the present invention contains a minimum of about 30 percent-by-weight solids are optionally at least 40 percent by weight solids and can contain about up to about 70 percent-by-weight solids and still be pumpable. This high solids loading is further advantageous in that transportation and disposal costs per unit weight of solids is reduced.

In the disposal of a typical waste stream, e.g., a refinery waste stream, EPA regulations including Boiler and Industrial Furnace (BIF) Rules permit the waste stream (sludge) to be incinerated, as for example in cement kilns, furnaces in spent sulfuric acid regeneration plants and the like, provided that the combustible solids plus any nonaqueous liquids present in the original waste stream have a minimum heat value of at least about 5000 BTU per pound. Thus, if the solids stream recovered from a typical refinery waste stream, which generally primarily contains water, has a minimum heat value of at least 5000 BTU per pound, such a solids stream can be incinerated in the manner mentioned above. Alternately, if liquid hydrocarbon or other nonaqueous liquids recovered from the waste stream are added back to the solids stream recovered from the waste stream, and the mixture of the recovered solids stream and added back nonaqueous stream has a minimum heat capacity of at least 5000 BTU per pound, the mixture can also be incinerated as described.

As noted above, the composition of the present invention can be, but is not necessarily, derived from refinery waste streams. Such streams can include, for example, API separator sludge, dissolved air flotation float, slop oil emulsion solids, tank bottoms (leaded), heat exchanger bundle cleaning sludge, primary oil/water/solids separation sludge, secondary (emulsified) oil/water/solids separation sludge, and oily tank bottom sludges. However, the source or feed stream for the composition need not be a waste stream from a refinery. For example, in numerous petrochemical, chemical and manufacturing operations, waste streams, primarily aqueous in nature, are produced which pose the same or similar disposal problems in that they contain hazardous solids and nonaqueous liquids. By way of example, paint, appliance and automotive manufacturing processes each generate waste streams containing hydrocarbon liquids, water and organic and inorganic solids. Similarly, aluminum smelting processes generate waste solids that are suitable for use in the fuel composition of the present invention. Thus, the composition of the present invention can be derived from any waste stream or streams, regardless of source. Wastes from the afore-mentioned sources that include solids having an average particle size of less than about 250 microns are particularly preferred.

A typical waste stream that can be used as the source of the composition of the present invention will generally contain from about 5 to about 30 percent-by-weight, nonaqueous liquids, from about 50 to about 95 percent-by-weight water and from about 1 to about 10 percent-by-weight solids. For example, a typical refinery waste stream will generally contain from about 10 to about 20 percent-by-weight nonaqueous liquids, from about 60 to about 90 percent-by-weight water and from about 2 to about 8 percent-by-weight solids.

If the composition of the present invention is to be derived from a waste stream such as a refinery sludge, it is convenient to separate the waste stream by using one or more well-known techniques such as, for example, distillation, extraction, decantation, centrifugation, filtration, etc., However, it is more convenient to effect separation of the waste stream as per the techniques and using apparatus disclosed in U.S. Pat. Nos. 4,810,393 and 4,931,176, both of which are incorporated herein by reference for all purposes. Using the processes and apparatus disclosed in the aforementioned patents, a typical waste stream, i.e., a refinery sludge containing about 80 percent-by-weight water, about 15 percent-by-weight liquid hydrocarbon and about 5 percent-by-weight solids, can be separated into an liquid hydrocarbon stream containing about 98 percent-by-weight liquid hydrocarbons, about 1 percent-by-weight water and about 1 percent-by-weight solids, a water stream containing about 98 percent-by-weight water, about 1 percent-by-weight liquid hydrocarbons and about 1 percent-by-weight solids, and a solids stream containing about 90 percent-by-weight water, about 1 percent-by-weight liquid hydrocarbons and about 9 percent-by-weight solids. Thus, there is provided a source for the three components of the composition. In some instances, all of the heat value of said composition are optionally derived from components initially present in said waste stream.

Any number of nonaqueous liquids can be employed to form the fuel slurry. Indeed, virtually any combustible organic material mentioned above used to form the fuel compositions of the present invention can be employed. For example, the nonaqueous liquid can conveniently comprise the nonaqueous stream recovered from the waste stream.

EXAMPLES

To more fully illustrate the present invention, the following non-limiting examples are presented.

Example 1

A typical refinery waste stream was separated into an aqueous stream, a liquid hydrocarbons stream and a solids stream. The solids stream was dried mechanically to produce a de-watered solids stream that contained about 59 percent-by-weight water, about 36 percent-by-weight weight solids and about 5 percent weight liquid hydrocarbons. The de-watered solids stream was then thermally dried to remove water and obtain a composition containing about 4 percent-by-weight water, about 84.3 percent-by-weight solids and about 11.7 percent-by-weight liquid hydrocarbons. The solids were later found to comprise about 10.95 percent-by-weight ash and about 35.05 percent-by-weight non-methylene chloride extractable organic solids, i.e, combustible solids. To the dried solids composition was added liquid hydrocarbons which had been separated from the waste stream to produce a fuel composition which contained about 8 percent-by-weight water, about 46 percent-by-weight solids and about 46 percent-by-weight liquid hydrocarbons. The fuel composition had a viscosity of 52 cps at 80° F. as measured by a Brookfield viscometer. The fuel composition had a heat content of 13,463 BTU per pound and was pumpable at ambient temperature.

Example 2

A typical refinery waste stream was separated into an liquid hydrocarbons stream, an aqueous stream and a solids stream that was 5 to 8 percent solids by weight. The solids stream was de-watered mechanically to produce a cake containing 54.1 percent-by-weight water, 32.5 percent-by-weight solids and 13.3 percent-by-weight liquid hydrocarbons. The de-watered cake was mixed with liquid hydrocarbons from the liquid hydrocarbons stream, forming a wet slurry. This wet slurry was transferred to a heating vessel and the temperature increased until boiling occurred. Boiling was continued until enough water was removed from the batch to yield a fuel having the following composition: 5 percent-by-weight water, 35 percent-by-weight solids and 60 percent-by-weight liquid hydrocarbons. The fuel composition had a viscosity of 1500 cps at 80° F. measured using a Brookfield Viscometer. The fuel had a heat value of 13,000 BTU per pound.

Example 3

Waste from the aluminum smelting industry, and more particularly waste characterized as spent potliner, comprises solids comprising approximately 50%–70% carbon, 5%–20% alumina, 10%–20% sodium salts, and 10%–15% fluoride salts. As generated, this waste typically has a heat value of approximately 8000 BTU/lb and takes the form of solid chunks. According to the present invention, this waste is fed to a ball mill, where it is ground into particles having an average size less than 250 microns. The ground waste is then mixed with sufficient liquid hydrocarbons to render it pumpable. The resulting fuel composition comprises less than 10 percent water and at least 30 percent by weight solids and remains pumpable and flowable.

Example 4

Paint waste from automotive, appliance and paint industries, which may come from paint overspray and/or paint production, comprises 20%–50% solvents, 5%–10% resins, 10%–15% pigments and typically has a heat value of at least 5000 BTU/lb. Paint waste tends to take the form of a thick sludge. According to the present invention, this waste is dewatered and then mixed with sufficient liquid hydrocarbons to render it pumpable, if necessary. The resulting fuel composition comprises less than 10 percent water and at least 30 percent by weight solids and remains pumpable and flowable.

Example 5

Various hydrocarbon-containing sludges produced in the course of petroleum refining operations are suitable feed streams for use in the present invention. These include, but are not limited to: crude oil storage tank sediment (sometimes referred to as K169); clarified slurry oil storage tank sediment and/or in line filter/separation solids (K170); spent hydrotreating catalyst (K171), including guard beds used to desulfurize feeds to other catalytic units; and spent hydrorefining catalyst (K172), including guard beds used to desulfurize feeds to other catalytic units. Each of these can be dewatered according to the present invention. Additional liquid hydrocarbons may or may not be added, depending on whether the dewatered stream is pumpable.

While the present fuel composition has been described according to a preferred embodiment, it will be understood that departures can be made from some aspect of the foregoing description without departing from the spirit of the invention. For example, the source and amount of solids and liquid hydrocarbons can be varied greatly, so long as the composition remains pumpable.

What is claimed is:

1. A composition for use as a fuel comprising:

water;

greater than about 30% by weight solids, said solids comprising inorganic solids and combustible organic solids; and from about 30 to about 70% by weight of liquid hydrocarbons, the composition having a minimum heat value of at least about 5,000 BTU per pound and viscosity such that said composition is a pumpable fluid at ambient temperature;

said solids being obtained from a petroleum refining waste stream; and said water forming less than about 10% by weight of the composition.

2. The composition according to claim 1 wherein said solids are obtained from a petroleum refining operation selected from the group consisting of: crude oil storage tank sediment, clarified slurry oil storage tank sediment, in line filter/separation solids, spent hydrotreating catalyst, and spent hydrorefining catalyst.

3. The composition according to claim 1 wherein said liquid hydrocarbons are obtained from a petroleum refining operation selected from the group consisting of: crude oil storage tank sediment, clarified slurry oil storage tank sediment, in line filter/separation solids, spent hydrotreating catalyst, and spent hydrorefining catalyst.

4. The composition according to claim 1 wherein all of the heat value of said composition is derived from components initially present in said waste stream.

5. The composition of claim 1 wherein the composition has a minimum heat value of at least about 7,000 BTU per pound.

6. The composition of claim 1 wherein the composition has a minimum heat value of at least about 10,000 BTU per pound.

7. The composition of claim 1, wherein the composition has a solid content of at least 40 percent.

8. The composition of claim 1 wherein said solids have an average particle size of less than about 250 microns.

9. A composition for use as a fuel comprising:

water;

greater than about 30% by weight solids, said solids comprising inorganic solids and combustible organic solids; and from about 30 to about 70% by weight of liquid hydrocarbons, the composition having a minimum heat value of at least about 5,000 BTU per pound and viscosity such that said composition is a pumpable fluid at ambient temperature;

said solids being obtained from an aluminum smelting operation; and said water being forming than about 10% by weight of the composition.

10. The composition according to claim 9 wherein at least a portion of the heat value of said composition is derived from components initially present in an aluminum smelting waste stream.

11. The composition of claim 9 wherein said solids have an average particle size of less than about 250 microns.

12. A composition for use as a fuel comprising:

less than about 10% by weight water;

greater than about 30% by weight solids, said solids comprising inorganic solids and combustible organic solids;

from about 30 to about 70% by weight of liquid hydrocarbons, the composition having a minimum heat value of at least about 5,000 BTU per pound and viscosity such that said composition is a pumpable fluid at ambient temperature;

said solids being obtained from paint waste.

13. The composition according to claim 12 wherein said liquid hydrocarbons are obtained from a paint waste.

14. The composition according to claim 12 wherein all of the heat value of said composition is derived from components initially present in paint waste.

15. The composition of claim 12 wherein said solids have an average particle size of less than about 250 microns.

* * * * *